US005921666A

United States Patent [19]

Preston et al.

[11] Patent Number: 5,921,666

[45] Date of Patent: Jul. 13, 1999

[54] ELLIPSOIDAL SLOT LIGHT

[75] Inventors: George V. Preston, Tupelo, Miss.; David S. Dean, Tucker, Ga.; L. Kevin Tillotson, Tupelo, Miss.

[73] Assignee: Thomas Lighting, Tupelo, Miss.

[21] Appl. No.: 08/811,258

[22] Filed: Mar. 4, 1997

[51] Int. Cl.[6] ..... F21V 7/08

[52] U.S. Cl. ..... 362/341; 362/225; 362/297; 362/346; 362/364

[58] Field of Search ..... 362/147, 241, 362/225, 297, 298, 343, 346, 364, 365, 348, 217, 227, 247, 341, 294

[56] References Cited

U.S. PATENT DOCUMENTS

| | | | |
|---|---|---|---|
| 3,805,052 | 4/1974 | Rambauske | 362/217 |
| 4,089,047 | 5/1978 | Luderitz | 362/297 |
| 4,295,186 | 10/1981 | Sugiura et al. | 362/217 |
| 4,425,604 | 1/1984 | Imai et al. | 362/247 |
| 4,517,631 | 5/1985 | Mullins | 362/346 |
| 5,526,237 | 6/1996 | Davenport et al. | 362/298 |

*Primary Examiner*—Y. Quach
*Attorney, Agent, or Firm*—Hill & Simpson

[57] ABSTRACT

A recessed ceiling light fixture is provided that includes a reflector with multiple ellipsoidal segments. Each ellipsoidal segment reflects light through a common focal point or area. Reflecting the light of each ellipsoidal segment through a common focal point or area, only a very narrow aperture is required. Further, improved light distribution and improved space to mounting height ratios are also provided by using a reflector with multiple ellipsoidal segments.

13 Claims, 3 Drawing Sheets

ELLIPSOIDAL SLOT LIGHT

BACKGROUND OF THE INVENTION

The present invention relates generally to lighting systems. More specifically, the present invention relates to recessed lighting systems.

Recessed lighting systems are known and are appreciated by architects and interior designers because of the clean appearance they can provide to a ceiling. However, architects and interior designers are demanding an even cleaner ceiling plane and are therefore requiring recessed lighting fixtures to be more efficient in terms of their lighting capabilities and are further requiring that the apertures of such fixtures be reduced or narrowed to provide an even cleaner ceiling plane.

The effectiveness of recessed light fixtures can be quantified by three separate characteristics: light distribution, the ratio of the light fixture spacing (S) divided by the ceiling height (MH), and aperture size. Obviously, an even light distribution is required and will depend upon the architects' choice of incandescent bulbs, fluorescent bulbs or halogen bulbs. The S:MH ratio represents the number of light fixtures, or space between light fixtures, required to light a room of a specific ceiling height. For example, if the ceiling height is 10 feet, the width of the room is 20 feet, and two lights spaced apart by a distance of 10 feet are required to light the room, the S:MH ratio is 10:10 or 1. A high S:MH ratio is desirable because it reflects a larger spacing between recessed light fixtures, a fewer number of light fixtures to light a room, and therefore a cleaner ceiling plane.

Finally, the size of the required aperture is also a measure of the efficiency of a recessed light fixture. Architects and interior designers are demanding smaller or narrower apertures to provide a cleaner ceiling plane. Less efficient recessed light fixtures require wider apertures in order to achieve the desired light distribution.

For example, as illustrated in FIG. 1, a light fixture 10 is illustrated that is mounted within a ceiling 11 that includes a parabolic reflector 12. While the parabolic reflector 12 is effective for fluorescent light fixtures, the parabolic reflector 12 includes a relatively broad aperture 13 and therefore does not provide the clean sealing plane demanded by today's architects. However, parabolic reflectors like that shown at 12 in FIG. 1 continue to be used for fluorescent light sources 14 because they achieve the requisite light distribution.

In contrast, FIG. 2 illustrates a recessed light fixture 20 that features an ellipsoidal reflector 22. The ellipsoidal reflector 22 is often used for incandescent light sources 23. Light is reflected off of the reflector 22 through a common focal point or focal area indicated at 24. Because light is being spread in all directions through the focal area 24, the reflector 22 can be provided with a narrower aperture 25 when compared to the aperture 13 for parabolic reflector 12 as illustrated in FIG. 1. In contrast, the parabolic reflector 12, simply reflects light downward while the ellipsoidal reflector 22 reflects light at varying angles through the focal area 24.

However, notwithstanding the improved light distribution and narrower aperture 25 of the ellipsoidal reflector 22, the ellipsoidal reflector 22 is still not suitable for fluorescent light sources because the ellipsoidal reflector has a tendency to spread the light in a manner that does not achieve an even light distribution or a reasonable space to mounting height ratio (S:MH). Further, while the aperture 25 is narrower than the aperture 13 illustrated in FIG. 1, architects and interior designers are demanding an even narrower aperture.

Accordingly, it would be desirable to provide an improved recess light fixture that provides the requisite light distribution, with a reasonable space to mounting height ratio, all with as narrow an aperture as possible.

SUMMARY OF THE INVENTION

The aforenoted needs have been addressed by the present invention which provides an ellipsoidal reflector with at least two ellipsoidal segments. A separate light source is provided for each ellipsoidal segment, but each ellipsoidal segment reflects light through a common focal point or area. The common focal area is disposed at or near the aperture. The aperture is centered within the reflector. The reflector housing includes a front panel that extends inward beyond the outer edges of the reflector to define a narrow aperture through which the reflected light passes. By providing a centered common focal area for all ellipsoidal segments, the light fixture of the present invention can be provided with a narrow aperture but still provide the requisite light distribution and space to mounting height ratio.

In an embodiment, the present invention provides an improved ellipsoidal reflector for recessed ceiling light fixtures that includes two ellipsoidal segments, two light sources and a common focal area.

In an embodiment, the present invention provides an improved ellipsoidal reflector for a recessed ceiling light fixture that includes three ellipsoidal segments, three light sources and a common focal area.

In an embodiment, the present invention provides an improved multiple ellipsoidal reflector for multiple incandescent light sources in a single recessed light fixture.

In an embodiment, the present invention provides an improved multiple ellipsoidal reflector for multiple fluorescent light sources in a single recessed light fixture.

In an embodiment, the present invention provides an improved multiple ellipsoidal reflector for multiple halogen light sources in a single recessed light fixture.

It is therefore an object of the present invention to provide an improved recessed light fixture which provides good light distribution, a good space to mounting height ratio and a narrow aperture.

Yet another object of the present invention is to provide a reflector for a recessed light fixture that includes at least two ellipsoidal segments.

Yet another object of the present invention is to provide an improved recessed light fixture which includes multiple light sources that reflect light off of a reflector and through a common focal area.

Still another object of the present invention is to provide an improved recessed light fixture with improved light distribution.

Yet another object of the present invention is to provide an improved recessed light fixture with an improved space to mounting height ratio.

And another object of the present invention is to provide an improved recessed light fixture with a narrow aperture than that previously available with fixtures having comparable light distributions and S:MH ratios.

Additional features, advantages and objects of the present invention are described in, and will be apparent from, the detailed description of the presently preferred embodiments and from the drawings.

It should be understood that the drawings are not necessarily to scale and that the embodiments are illustrated by sectional views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
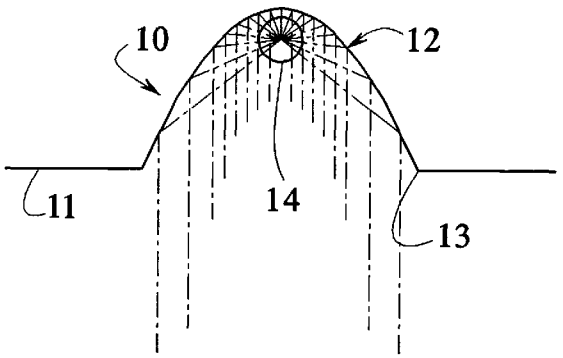
FIG. 1 PRIOR ART
FIG. 1 is a sectional view of a recessed light fixture featuring a parabolic reflector as taught by the prior art.
Figure 3:
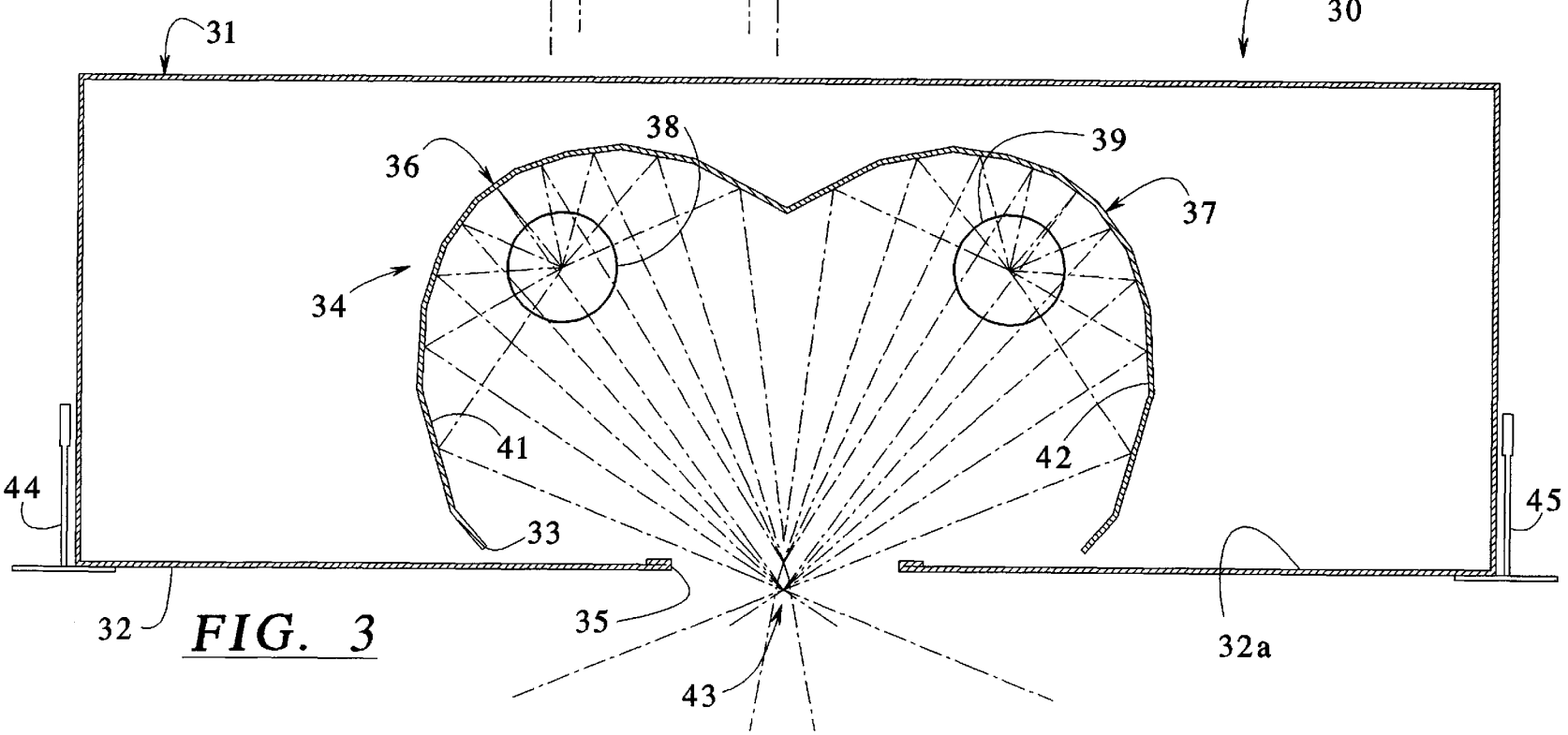
FIG. 3 is a sectional view of a recessed light fixture made in accordance with the present invention.
Figures 2, 4:
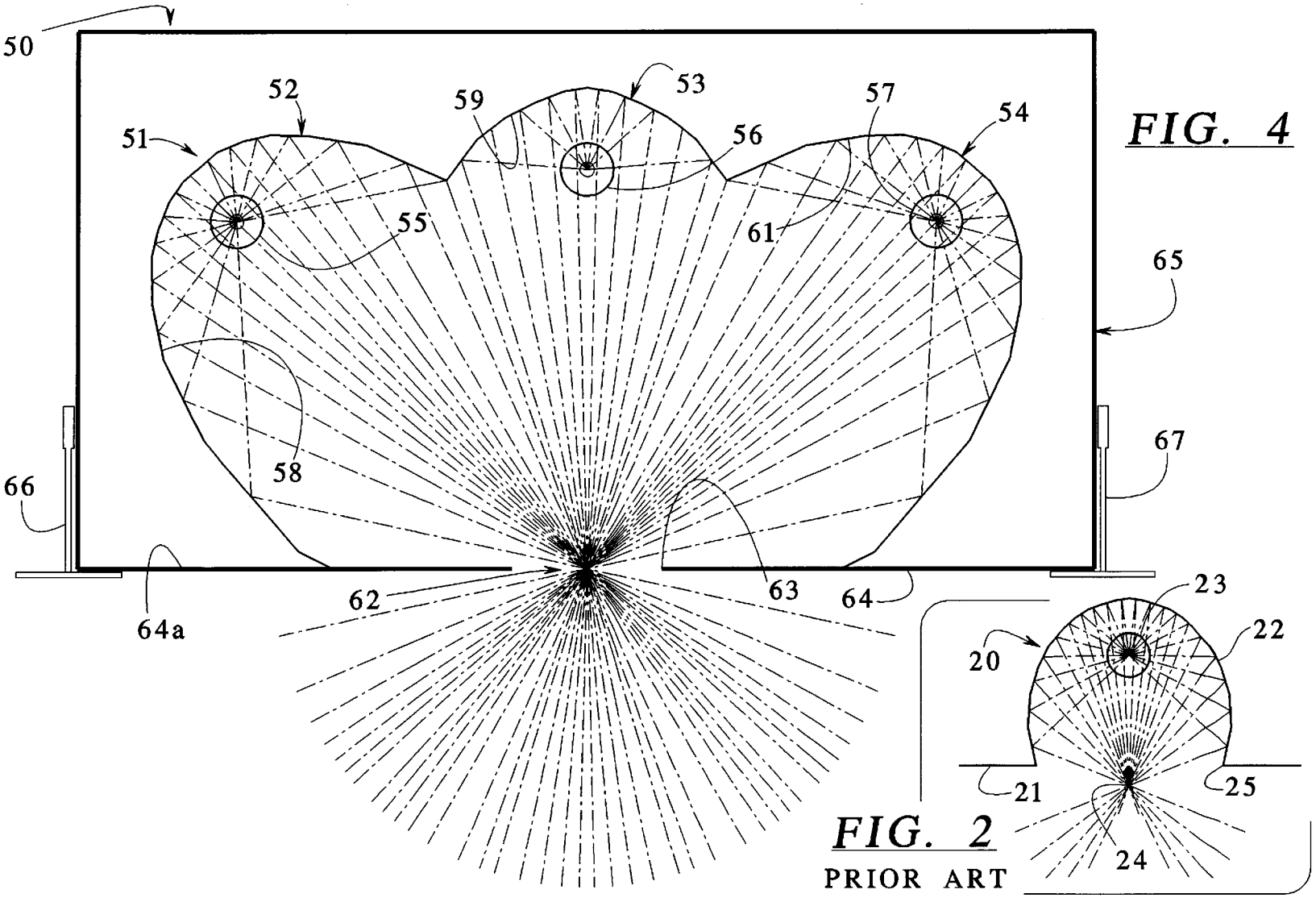
FIG. 2 PRIOR ART
FIG. 2 is a sectional view of a recessed light fixture featuring an ellipsoidal reflector as taught by the prior art.
FIG. 4 is a sectional view of a recessed light fixture made in accordance with the present invention.

FIG. 3 illustrates a recessed light fixture 30 made in accordance with the present invention that provides a substantial improvement over the fixtures 10 and 20 illustrated in FIGS. 1 and 2 respectively. The fixture 30 includes a housing 31 that includes a front panel 32. The front panel 32 extends inward past the outer edge 33 of the reflector 34 to define an aperture shown at 35. As illustrated in FIG. 3, the aperture 35 is substantially narrower than the reflector 34. The reflector 34 illustrated in FIG. 3 includes two ellipsoidal segments 36 and 37. Each segment 36, 37 includes a separate light source 38, 39. The reflector 34 provides specular reflection off the inside surfaces 41, 42 of the reflector 34. Substantially all of the light reflected off the inside surface 41 as well as substantially all of the light reflected off the inside surface 42 passes through the common focal point or area indicated at 43.

Obviously, the reflector 34 could be designed so that all light reflected off the inside surfaces 41, 42 pass through a narrowly defined point or the reflector 34 could be designed so that all light reflected off the surfaces 41, 42 pass through a broader space, or an area. Hereinafter, the focal point or area indicated at 43 will be referred to as the focal area 43 for purposes of simplicity. However, it is intended that multiple ellipsoidal reflectors that reflect light through a narrowly defined point or through a somewhat broader area fall within the spirit and scope of the present invention.

Because the reflected light passes through the focal area 43, the aperture 35 can be narrower than prior art recessed light fixtures. The front panel 32 will lie in the same plane as the ceiling (not shown). Support brackets shown at 44, 45 may be employed to hold the housing 31 in place. The brackets 44, 45 and the front panel 32 may be blended into the ceiling (not shown) with plaster or other suitable construction materials.

FIG. 4 illustrates an alternative embodiment light fixture 50 of the present invention which includes a triple ellipsoidal reflector 51 or a reflector 51 that includes three ellipsoidal segments 52, 53 and 54. Each segment 52, 53 and 54 includes a separate light source 55, 56 and 57. Light from each light source 55, 56 and 57 is reflected off the interior surfaces 58, 59 and 61 through a common focal area 62. The focal area 62 is disposed approximately along an even plane with the aperture 63, which is disposed in the front panel 64 of the housing 65. The housing 65 is supported in the ceiling (not shown) by brackets 66, 67.

The light sources 38, 39, 55, 56 and 57 may be halogen, incandescent or fluorescent or other suitable light sources. One advantage of the multiple ellipsoidal reflectors 34, 51 of the present invention is that they can be utilized with a variety of light sources.

Further, by passing through light from a plurality of light sources 38, 39 or 55, 56, 57 through a common focal area such as 43 or 62, which are disposed at or inside of the inside planar surfaces 32*a* and 64*a* of the front panels 32, 64 respectively, light fixtures made in accordance with the present invention can provide superior light distribution and excellent space to mounting height ratios. Specifically, space to mounting height ratios of approximately 2 or more are achievable for fluorescent light bulbs utilizing light fixtures made in accordance with the present invention. Previously, space to mounting height ratios for fluorescent bulbs of only 1.2 to 1.4 were available.

Figure 5:
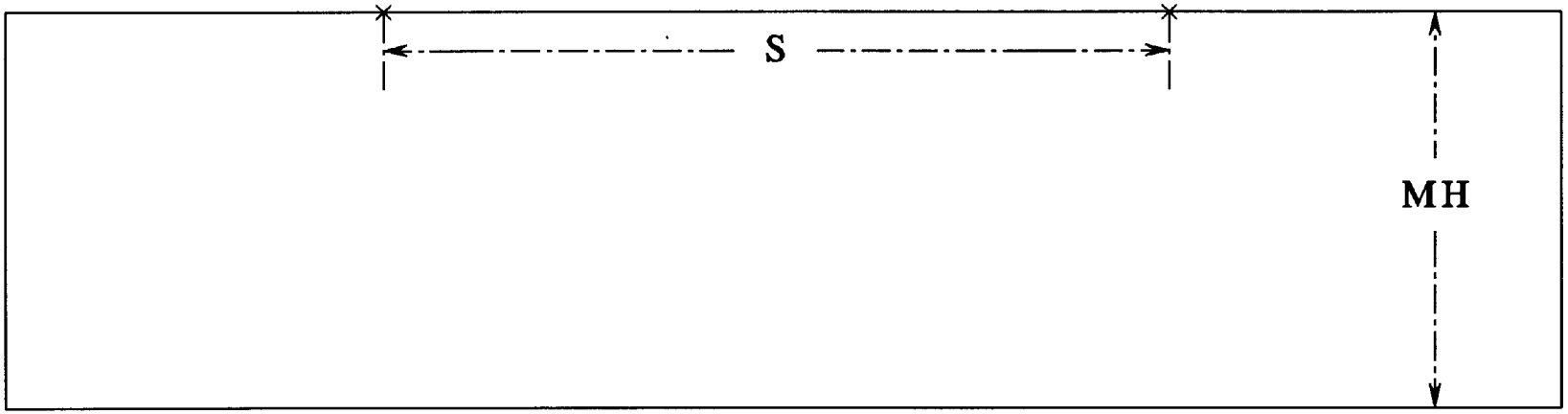
FIG. 5 is a schematic illustration of a spacing to mounting height ratio (S:MH) of about 2.

A space to mounting height ratio of about 2 is illustrated in FIG. 5. Finally, it will be noted that the apertures shown at 35 in FIG. 3 and 63 in FIG. 4 are substantially narrower than the spacing between the light sources 38, 39 and 55, 56 or 56, 57 respectively. The narrow apertures 35, 63 provide a sealing plane having a clean and aesthetically pleasing appearance.

From the foregoing description, it is apparent that the present invention is susceptible of being embodied with various alterations and modifications which may differ from those that have been described above. It should be understood that we wish to embody within the scope of the patent warranted hereon all such modifications as reasonably and properly come within the scope of our contribution to the art.

We claim as our invention:

1. A recessed light fixture comprising:

a housing including a front panel, the front panel having a narrow aperture for passing light through the aperture, the aperture having a width, an elongated reflector disposed within the housing, the reflector having a front edge facing an inside surface of the front panel, the front edge surrounding the aperture, the reflector also including an inside surface, the inside surface including at least two segments having ellipsoidal cross sections, the reflector further including an elongated light source disposed in front of and parallel to each ellipsoidal segment, each segment reflecting light generated by its respective light source through the aperture, the light sources being spaced apart by a distance which is greater than the width of the aperture, each of said ellipsoidal segments has an elongated common focal area, the focal area being located along a common plane of the front panel and the aperture.

2. The light fixture of claim 1, wherein the light sources are fluorescent light sources.

3. A recessed light fixture system for mounting in a ceiling of a predetermined height and directing light downward toward an area of a floor disposed therebelow, the light fixture system comprising:

a plurality of elongated housings, each of said housings including a front panel disposed along a common plane with the ceiling, each front panel having a narrow aperture for passing light through the aperture, each aperture having a width, each of said housings accommodating an elongated reflector disposed within the housing, each reflector having a front edge facing an inside surface of the front panel, each front edge surrounding the aperture, each reflector also including an inside surface, the inside surface including at least two segments, each segments having an ellipsoidal cross section, each reflector further including an elongated light source disposed in front of and parallel to each ellipsoidal segment, the light sources being spaced apart by a distance which is greater than the width of the aperture, each segment reflecting light generated by its respective light source through its respective aperture and onto the area of the floor, the apertures being spaced apart along the ceiling by a predetermined spacing, each of said ellipsoidal segments has a common focal area, the focal area being located along a common plane of the front panel and the aperture.

4. The light fixture system of claim 3, wherein the ratio of the predetermined spacing to the predetermined height of the ceiling ranges from about 1 to about 3.

5. The light fixture system of claim 3, wherein the light sources are fluorescent light sources.

6. A recessed light fixture comprising:

a housing including a front panel, the front panel having an aperture for passing light through the aperture, a reflector disposed within the housing, the reflector having a front edge facing an inside surface of the front panel, the front edge surrounding the aperture, the reflector also including an inside surface, the inside surface including at least two ellipsoidal segments, the reflector further including a light source disposed in front of each ellipsoidal segment, each ellipsoidal segment reflecting light generated by its respective light source through the aperture, each of said ellipsoidal segments has a common focal area, the focal area being located inside of the front panel and the aperture.

7. The light fixture of claim 6 wherein the light sources are incandescent.

8. The light fixture of claim 6 wherein the light sources are fluorescent.

9. The light fixture of claim 6 wherein the light sources are halogen.

10. A recessed light fixture system for mounting in a ceiling of a predetermined height and directing light downward toward an area of a floor disposed therebelow, the light fixture system comprising:

a plurality of housings, each of said housings including a front panel disposed along a common plane with the ceiling, each front panel having an aperture for passing light through the aperture, each of said housings accommodating a reflector disposed within the housing, each reflector having a front edge facing an inside surface of the front panel, each front edge surrounding the aperture, each reflector also including an inside surface, the inside surface including at least two ellipsoidal segments, each reflector further including a light source disposed in front of each ellipsoidal segment, each ellipsoidal segment reflecting light generated by its respective light source through its respective aperture and onto the area of the floor, the apertures being spaced apart along the ceiling by a predetermined spacing, each of said ellipsoidal segments have a common focal area, the focal area being located inside of the front panel and the aperture.

11. The light fixture system of claim 10 wherein the light sources are incandescent.

12. The light fixture system of claim 10 wherein the light sources are halogen.

13. The light fixture system of claim 10 wherein the light sources are fluorescent.

* * * * *